US005957611A

United States Patent [19]

Whaley

[11] Patent Number: 5,957,611

[45] Date of Patent: Sep. 28, 1999

[54] RING BINDER WITH DUAL ANGLE RING METAL

[75] Inventor: Paul Whaley, Jefferson, Mo.

[73] Assignee: U.S. Ring Binder Corporation, New Bedford, Mass.

[21] Appl. No.: 08/910,094

[22] Filed: Aug. 12, 1997

[51] Int. Cl.[6] ..... B42F 3/04

[52] U.S. Cl. ..... 402/31; 402/36; 402/32; 402/34; 402/35; 402/38; 402/41; 402/42; 402/26; 402/39

[58] Field of Search ..... 402/31, 36, 35, 402/34, 32, 38, 41, 42, 26, 39

[56] References Cited

U.S. PATENT DOCUMENTS

| | | | |
|---|---|---|---|
| 3,098,490 | 7/1963 | Wance | 129/24 |
| 4,552,478 | 11/1985 | Cohen | 402/39 |
| 5,116,157 | 5/1992 | Gillum et al. | 402/38 |
| 5,286,128 | 2/1994 | Gillum | 402/39 |
| 5,476,335 | 12/1995 | Whaley | 402/26 |
| 5,755,525 | 5/1998 | Chan | 402/36 |

*Primary Examiner*—Willmon Fridie, Jr.
*Assistant Examiner*—Alisa Thurston
*Attorney, Agent, or Firm*—Polster, Lieder, Woodruff & Lucchesi, L.C.

[57] ABSTRACT

A ring binder (10) holding sheets (S) of paper (P) has a dual angle ring metal (100). The ring metal includes a pair of leaves (102, 104) hingedly connected to each other for relative movement between them. Binder rings (114, 116, 118) each include a pair of ring halves with one end of each ring half being attached to a separate one of the leaves. A shield (30) covers the leaves. Release levers (140, 142) at each end of the shield are operable to open and close the binder. The leaves, when the ring binder is closed, form a predetermined angle (A) with respect to each other. Each of the leaves has a segment (**122*a*, 122*b*, 124*a*, 124*b***) by which a second angle (B) is formed between the leaves. This second angle is formed such that the pair of leaves are prevented from movement relative to each other by movement of paper from one side of the binder to the other. However, the plates are readily movable to open the binder by movement of one of the release levers.

25 Claims, 5 Drawing Sheets

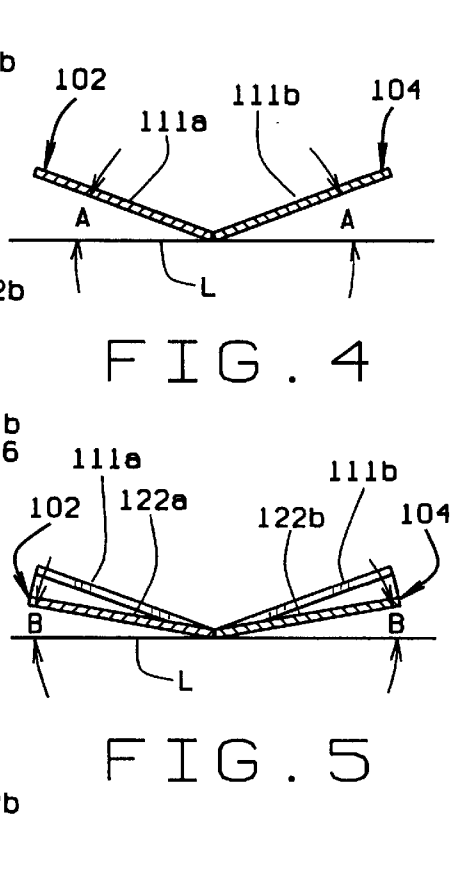
FIG. 4
FIG. 5
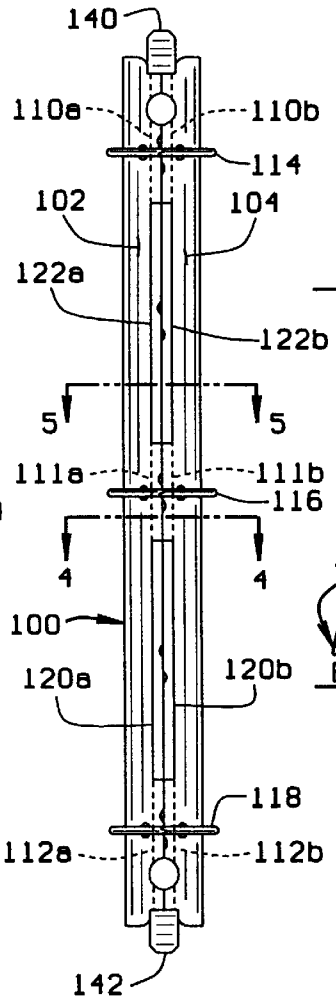
FIG. 3
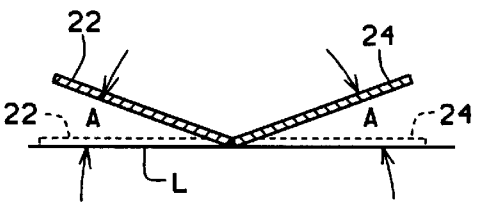
FIG. 2B
PRIOR ART
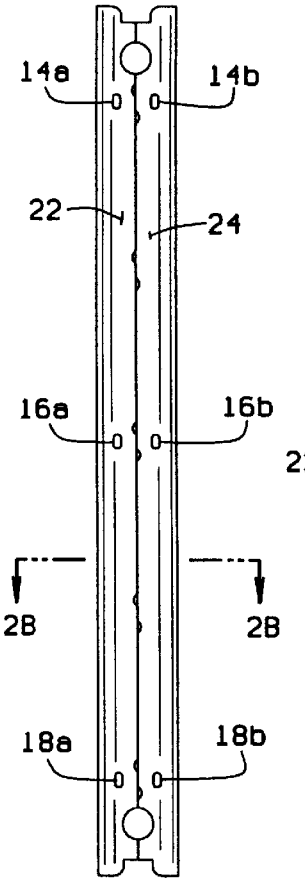
FIG. 2A
PRIOR ART

RING BINDER WITH DUAL ANGLE RING METAL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binders used for holding hole punched paper and the like, and more particularly, to a ring binder employing a dual angle ring metal which prevents unintended or accidental opening of the ring binder but which allows the binder to be readily opened and closed when desired.

Ring binders hold and store punched sheets of paper and other suitably hole punched materials. A locking/release mechanism commonly used in ring binders includes a thumb or finger operated latch located at each end of the mechanism. A pair of latch plates extend lengthwise of the ring binder and binder ring halves are attached to each plate at spaced intervals along the length of the binder. When a user presses against a latch, the respective plates are rotated relative to each other to pull apart (open) the binder rings so paper can then be inserted or removed from the binder. The user then presses against the separated sections of a binder ring to snap or push them together and close the binder.

Current locking mechanisms have certain drawbacks. One of these is referred to as "sponginess" which is, in effect, a soft opening of the ring binder. The latch plates are covered by a shield extending lengthwise of the binder and having spaced openings for the respective binder ring halves to extend through the shield. This shield is made of a spring metal. When the binder is closed, the latch plates are at an angle to each other. Movement of paper from one side of the binder to the other causes a force to be exerted on the binder ring halves on one side of the binder and this force is transmitted to the latch plates. In consequence, the latch plates rotate relative to each other in a binder opening direction. They will continue to do so until the plates reach a position where they exert a force on each other which prevents their further opening movement. The amount of plate travel, and consequent binder ring opening produces a soft or spongy effect in that there is not a solid closure of the binder at all times. The "sponginess" can sometimes result in inadvertent opening of the binder and spillage of its contents. The present invention addresses this problem and provides a solution to it.

BRIEF SUMMARY OF THE INVENTION

Among the several objects of the present invention may be noted the provision of a ring binder for holding punched sheets of paper or the like;

the provision of such a ring binder whose construction and operation prevents "sponginess" and inadvertent or accidental binder opening;

the provision of such a ring binder having a dual angle ring metal construction which prevents soft opening of the binder rings and possible spillage of binder contents;

the provision of such a ring binder in which latch plates to which binder ring halves are secured, and whose movement causes the binder ring halves to be separated to open the binder, have respective sections forming a first angle of one plate to the other, and other sections forming a second angle of one plate to the other;

the provision of such a ring binder in which the angle formed between the plates at the second sections prevent movement of the plates relative to each other due to forces caused by paper shifting from one side of the binder to the other;

the provision of such a ring binder in which the angle formed between the plates at the first sections allow the plates to move relative to each other when the binder is opened;

the provision of such a ring binder in which the provision of the respective sections does not interfere with, or make difficult, the normal functioning of the ring metal to open and close the binder;

the provision of such a ring binder in which the respective angled sections are readily accommodated in the ring metal construction and do not increase the cost of the binder; and, the provision of such a solution which is an effective, low cost, and easily implemented solution to the "sponginess" problem.

In accordance with the invention, generally stated, a ring binder holding hole punched sheets of paper includes a pair of leaves hingedly connected to each other for relative movement between them. A plurality of binder rings are each formed of a pair of ring halves with one end of each ring half being attached to a separate one of the leaves for movement of the leaves relative to each other to move the ring halves to open and close the ring binder. A shield covers the leaves and release levers located at each end of the shield. The release levers are operable by a user of the ring binder to move the leaves to open and close the binder. The leaves, when the ring binder is closed, form a predetermined angle with respect to each other. Each of the leaves has a segment at which a second angle is formed between the leaves. This second angle is such that the leaves are prevented from movement relative to each other because of movement of paper stored in the binder from one side of the binder to the other. However, the plates are readily movable to open the binder when a user moves one of the release levers. Other objects and features will be in part apparent and in part pointed out hereinafter.

BRIEF DESCRIPTION OF THE SEVERAL VIEWS OF THE DRAWINGS

In the drawings.

FIG. 2A is a plan view of a prior art ring metal assembly, and FIG. 2B is a sectional view taken along line 2B—2B in FIG. 2A;

FIG. 3 is a plan view of a first embodiment of a leaf construction of the present invention;

FIG. 4 is sectional view taken along line 4—4 in FIG. 3;

FIG. 5 is a sectional view taken along line 5—5 in FIG. 3;

Corresponding reference characters indicate corresponding parts throughout the drawings.

DETAILED DESCRIPTION OF THE INVENTION

Figure 1:
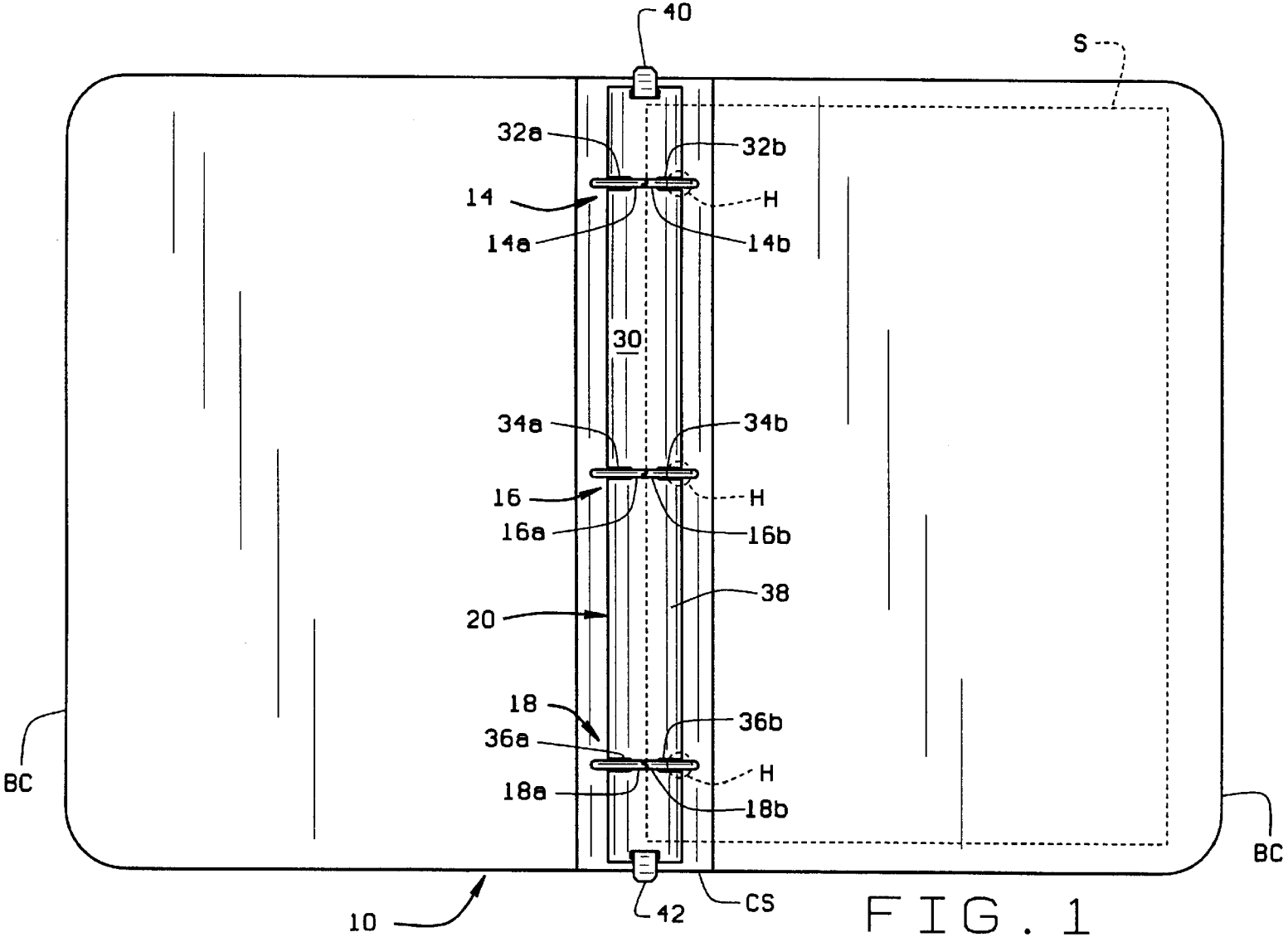
FIG. 1 is a representation of a ring binder of the present invention.

Referring to the drawings, a ring binder of the present invention is indicated generally 10 in FIG. 1. The ring binder is used to hold and store sheets S of paper. Ring binder 10 has respective end covers EC and a center spine portion CS. The sheets of paper have holes H punched in them and the sheets are secured in the ring binder by inserting the holes over binder ring segments of binder rings 14, 16, and 18. The binder rings form a portion of a ring metal 20 which is attached to the center spine portion of the ring binder. As shown in FIG. 1, each binder ring has respective segments 14*a*, 14*b*, 16*a*, 16*b*, and 18*a*, 18*b*. In FIG. A, a prior art ring metal is shown to include a pair of elongate, rectangular, interlocking plates 22, 24. One end of the respective binder ring segments are attached to each of these plates. The plates are mounted within a cover or shield 30 which has openings 32*a*, 32*b*, 34*a*, 34*b*, and 36*a*, 36*b* in its upper surface 38 through which the respective ring segments project. The sides of the cover plate are folded over, about the sides of the respective plates, to capture the plates and hold them in place. Respective lever arms 40, 42 are mounted at opposite ends of the ring metal to move plates 22, 24 and effect opening of the binder rings. One end of the lever arms operate against respective ends of the plates. The lever arms extend upwardly through respective openings 44, 46 in cover plate 30. A person opens the binder by either pulling the binder ring segments apart, or by pushing down on the exposed end of one of the lever arms.

As previously noted, movement of paper from one side of the binder to the other; or the force exerted on the binder rings segments on one side of the binder, when the binder is held generally vertically angle, can cause inadvertent opening of the binder. As shown in FIG. 2B, there is an angle A formed between each of the plates 22, 24 and a reference line L. In the prior art construction of FIG. 2A, this angle is uniform throughout the length of the plates. A force exerted on the binder ring segments tends to cause the segments to rotate in opposite directions so the plates move from their solid line position in FIG. 2B toward their dashed line configuration in the figure. As they do so, the angle formed by the respective plates becomes shallower. Only when the plates reach their dashed line (shallower angle) position do their forces countervail so there is no further rotational movement of the plates. Since any movement of the plates causes a separation of the binder ring segments where they are closed, this movement is undesirable since it creates a partial separation or opening of the binder rings.

Referring to FIGS. 3–5, a ring metal 100 of the present invention is shown as having a pair of elongate, rectangular, interlocked plates 102, 104. Plates 102, 104 are similar to the plates 22, 24 in that the respective ends of ring binder segments are attached to the plates. Further, the plates are sized to fit within cover 30 for segments of respective binder rings 114, 116, 118 to fit through openings in the cover. Plates 102, 104 each have respective corresponding segments 110*a*, 110*b*, 111*a*, 111*b*, and 112*a*, 112*b* at which the adjacent edges of the plates form the angle A with respect to the reference line L. Lever arms 140, 142 are located at each end of the ring metal for opening and closing the binder rings. Plates 102, 104 further have respective corresponding segments 120*a*, 120*b*, and 122*a*, 122*b* at which the adjacent edges of the plates form a second angle B with respect to the reference line L (see FIG. 5). The second angle B formed by these plate segments is a shallower angle than the angle A (see FIG. 4). For example, the first angle A may be 17° while the second angle B is 12°. Thus, at certain sections along the length of the ring metal, the plates 102, 104 form one angle with respect to each other, and at other sections a different angle with respect to each other. The effect of this second angle is to establish the plate condition referred to in the above discussion concerning the prior art ring metal construction. To normally open the ring binder the user pushes down on one of the levers, 140, 142. The lever contacts both the leaves 102, 104 and pushing down on the lever rocks the leaves causing a counterclockwise rotation of leaf 102, and a clockwise rotation of leaf 104, as shown in FIG. 5. Because it is desirable to make the binder relatively easy to open, not much pressure is required on the lever to cause this rotational movement. A force, however slight, created by the shifting of sheets is resisted by a countervailing force created by the adjacent surfaces of the leaves abutting into each other. That is, contact of the faces at sections 120*a*–120*b* and 122*a*–122*b* resists the forces acting to rotate the leaves. That is, by creating the shallower angle at which the plates exert a countervailing force on each other at the normally closed ring binder position, any "sponginess" in the ring metal is substantially eliminated. Now, any force on the binder rings caused by the force of the weight of paper against the ring halves will not cause the leaf plates to move relative to each other causing the binder rings to separate. Moreover, because a substantial portion of the plates still form the first angle, the force normally required by a user to open the binder is relatively unaffected.

Figure 7:
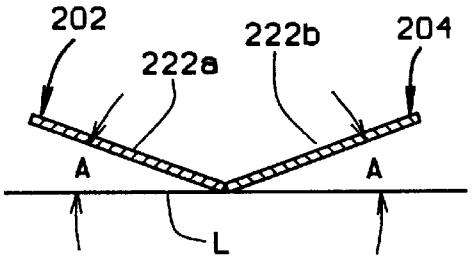
FIG. 7 is a sectional view taken along line 7—7 in FIG. 6.
Figure 8:
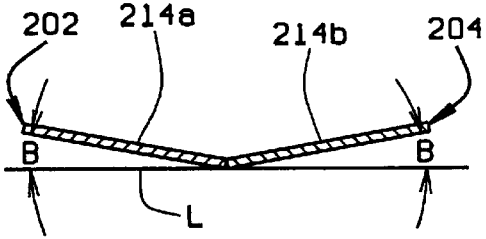
FIG. 8 is a sectional view taken along line 8—8 in FIG. 6.
Figure 6:
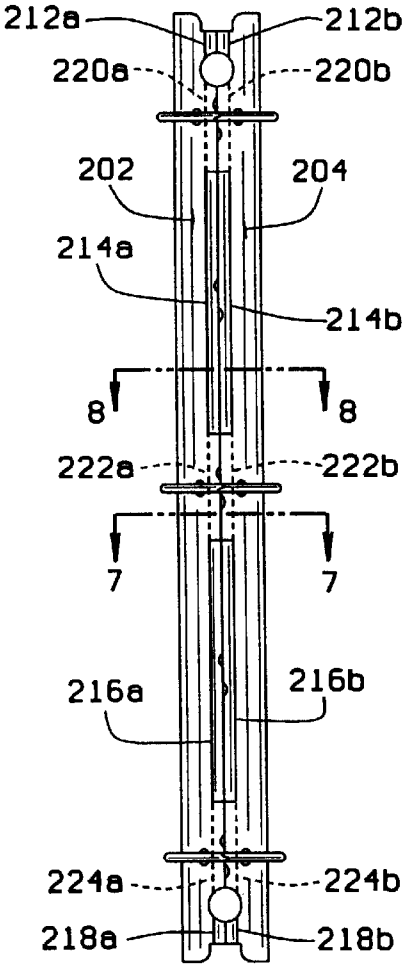
FIG. 6 is a plan view of a second embodiment of a leaf construction of the present invention.
Figure 9:
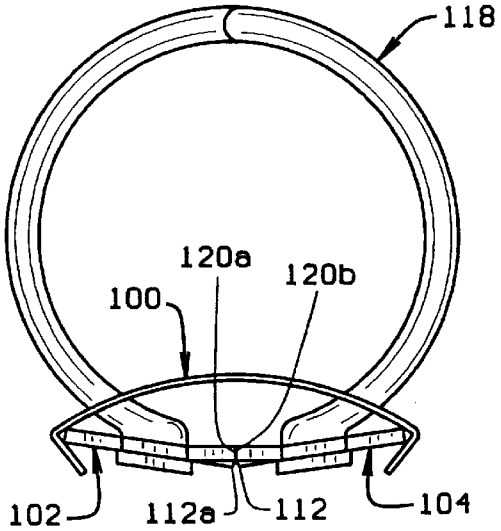
FIG. 9 is a side elevational view of the leaves of the ring binder metal illustrating the leaf construction of the leaves to which respective halves of the binder rings are attached and whose movement opens and closes the binder rings, the binder rings being shown in their closed position.
Figure 10:
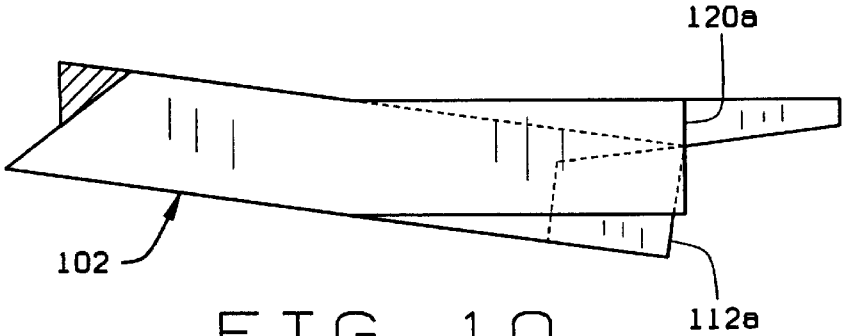
FIG. 10 is an elevational view of one of the leaves.
Figure 11:
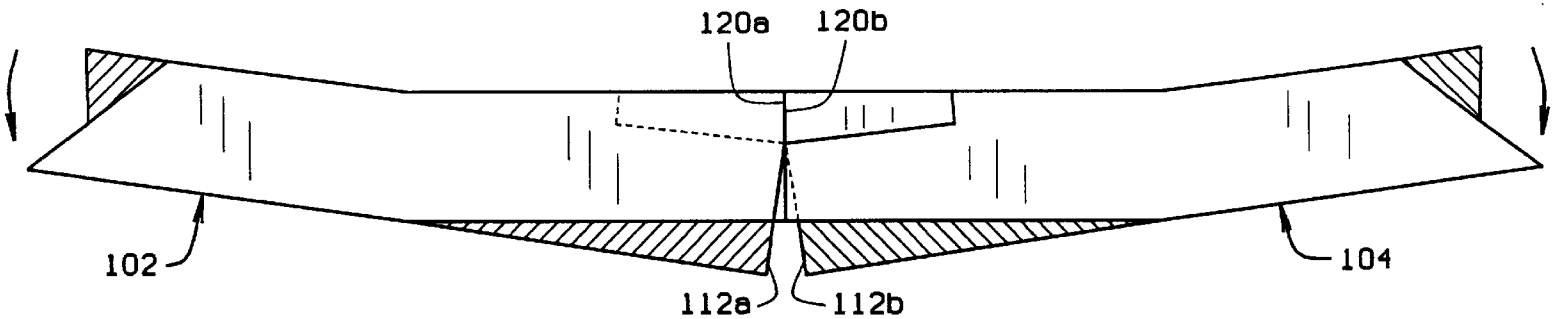
FIG. 11 is an elevational view of both leaves.
Figure 12:
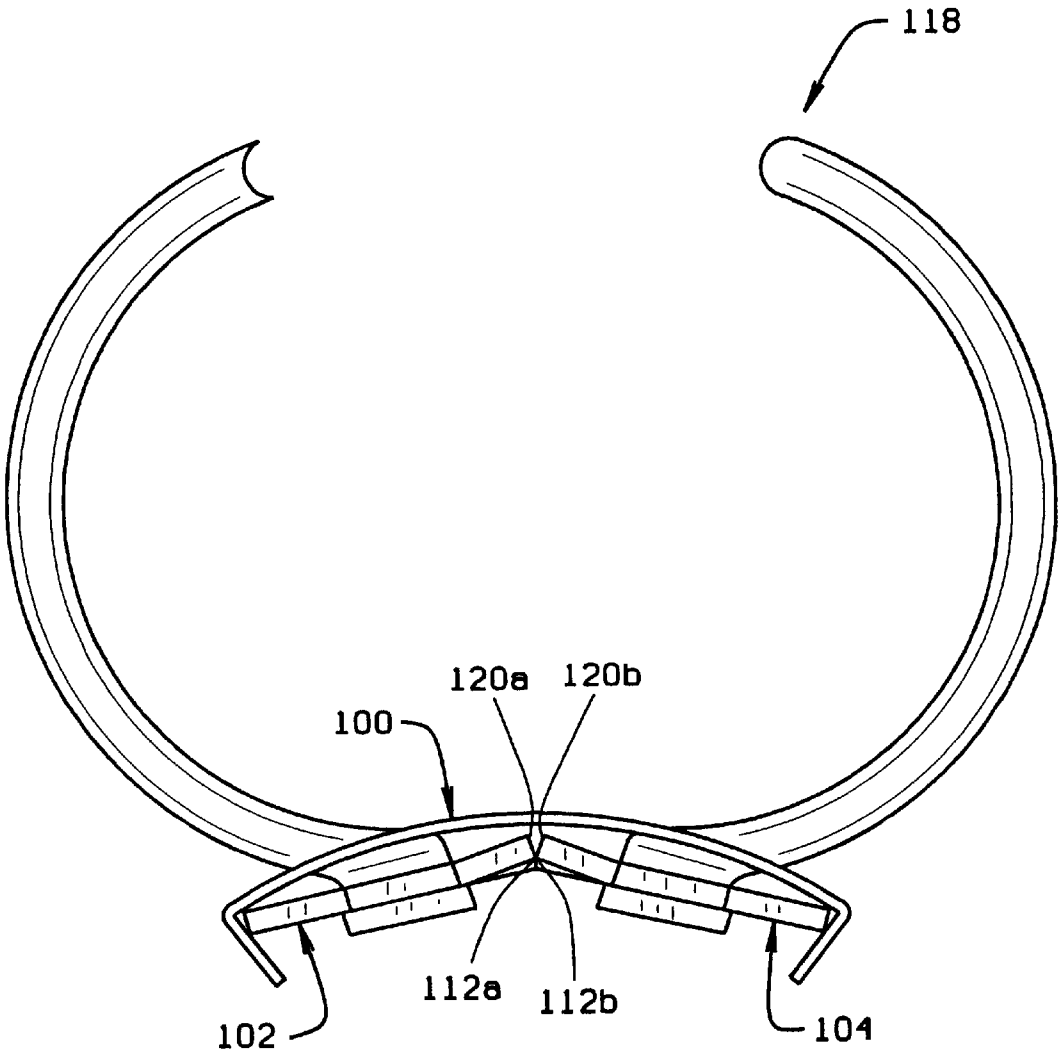
FIG. 12 is a view similar to FIG. 9, but with the binder rings opened.

It will be understood that the number of segments of each leaf plate formed to create the second and shallower angle, may vary. In the one embodiment shown, a three ring binder has segments formed in each leaf plate intermediate the location on the plates where one end of each binder ring half is secured to the plate. In the other embodiment shown, (FIGS. 6–8), not only are segments (214*a*, 214*b*, 216*a*, 216*b*) formed intermediate adjacent binder rings, but additional segments (212*a*, 212*b*, 218*a*, 218*b*) are formed adjacent each end of each plate 202, 204. The embodiments shown in the drawings are examples only, and those skilled in the art will recognize variations which can be made without departing from the scope of the invention. These include variations in the length of the segments forming the shallower angles, forming more than one segment between adjacent binder rings, not having a segment between one set of adjacent binder rings while having a segment between the next set so that there is an alternation. All of these variations can be used depending upon the size of the binder, the type of paper or other hole punched material stored in the binder, the number of binder rings, etc.

What has been described is a ring binder having a ring metal construction which prevents "sponginess" and inadvertent opening of the binder. For this purpose, the ring metal has a dual angle construction in which latch plates to which binder ring halves are secured and whose movement causes the binder ring halves to be separated to open the binder have respective sections forming a first angle of one plate to the other, and other sections forming a second angle of one plate to the other. The angle formed between the plates at the sections forming the second angle prevents movement of the plates relative to each other due to forces caused by paper shifting from one side of the binder to the other. The angle formed between the plates at the sections forming the first angle allows the plates to move relative to each other when the binder is opened. Providing such a dual angle ring metal construction does not interfere with, or make difficult, the normal functioning of the ring metal to open and close the binder. Further, the respective angled sections are readily accommodated in the ring metal construction and does not increase the cost of the binder so an effective, low cost, and easily implemented solution to the "sponginess" problem is provided.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A ring binder for holding hole punched sheets of paper comprising:

a pair of leaves hingedly connected to each other for relative movement therebetween;

at least one binder ring formed of a pair of ring halves, one end of each ring half attached to a separate one of the leaves for movement of said leaves relative to each other to move the ring halves to open and close the ring binder; and, release levers located at each end of said leaves and operable by a user of said ring binder to move said leaves to open and close the binder, said leaves, when said ring binder is closed, forming a predetermined angle with respect to a reference, and each of said leaves having at least one segment by which a second angle is formed with respect to said reference, said second angle being such that surfaces of said leaves where said second angle is formed contact each other and prevent binder ring opening movement which otherwise would occur due to movement of paper stored in the binder from one side of the binder to the other, but said leaves are otherwise readily movable to open said binder when a user moves one of the release levers to open the binder.

2. The ring binder of claim 1 wherein said leaves each have a plurality of said segments by which said second angle if formed with respect to said leaves.

3. The ring binder of claim 2 wherein said second angle is a shallower angle than said predetermined angle.

4. The ring binder of claim 3 wherein said predetermined angle is approximately 17° and said second angle is approximately 12°.

5. The ring binder of claim 3 further including a plurality of binder rings spaced apart along the length of said binder, and a plurality of segments formed in each of said leaves with at least one segment formed intermediate the location where adjacent binder ring halves are attached to a leaf.

6. The ring binder of claim 5 further including an additional segment formed on each leaf between the location where an outer binder ring half attaches to said leaf and the end of said leaf.

7. The ring binder of claim 6 further including a cover fitting over said leaves and having spaced openings formed therein along the opposites thereof for the respective binder ring halves to extend through said cover.

8. The ring binder of claim 1 including three binder rings with one binder ring located at the respective ends of the binder and a binder ring is located in the middle of said binder, and segments forming said second angle are formed at each end of each leaf and on each leaf intermediate adjacent binder rings.

9. In a ring binder for holding hole punched sheets of paper, the binder including a center spine section and end covers extending from opposite sides of said spine, a dual angle ring metal secured to said spine and comprising:

a pair of leaves hingedly connected to each other for relative movement therebetween;

a plurality of binder rings spaced along the length of said ring metal, each binder ring being formed of a pair of ring halves one end of each ring half being attached to a separate one of the leaves for movement of said leaves relative to each other to move the ring halves to open and close the ring binder; and, release levers located at each end of said ring metal and operable by a user of said ring binder to move said leaves to open and close the binder, said leaves, when said ring binder is closed, forming a predetermined angle with respect to a reference, and each of said leaves having at least one segment by which a second angle is formed with respect to said reference, said second angle being such that surfaces of said leaves where said second angle is formed contact each other to prevent binder ring opening movement which would otherwise occur due to movement of paper stored in the binder from one side of the binder to the other, but said leaves are otherwise readily movable to open said binder when a user moves one of the release levers to open the binder.

10. The ring metal of claim 9 further including a plurality of segments formed in each of said leaves with at least one segment formed intermediate the location where adjacent binder ring halves are attached to a leaf.

11. The ring metal of claim 10 further including an additional segment formed on each leaf between the location where an outer binder ring half attaches to said leaf and the end of said leaf.

12. The ring metal of claim 11 wherein said second angle is a shallower angle than said predetermined angle.

13. The ring metal of claim 12 wherein said predetermined angle is approximately 17° and said second angle is approximately 12°.

14. The ring metal of claim 13 further including a cover fitting over said leaves and having spaced openings formed therein along the opposites thereof for the respective binder ring halves to extend through said cover.

15. A dual angle ring metal for use with a ring binder comprising:

a pair of leaves hingedly connected to each other for relative movement therebetween;

a plurality of binder rings spaced along the length of said ring metal, each binder ring being formed of a pair of ring halves one end of each ring half being attached to a separate one of the leaves for movement of said leaves relative to each other to move the ring halves to open and close the ring binder;

a cover fitting over said leaves and having spaced openings formed therein along the opposites thereof for the respective binder ring halves to extend through said cover;

release levers located at each end of said ring metal and operable by a user of said ring binder to move said leaves to open and close the binder; and, said leaves, when said ring binder is closed, forming a predetermined angle with respect to a reference, and each of said leaves having at least one segment by which a second angle is formed with respect to said reference, said second angle being such that surfaces of said leaves where said second angle is formed contact each other to prevent binder ring opening movement which would otherwise occur due to movement of paper stored in the binder from one side of the binder to the other, but said leaves are otherwise readily movable to open said binder when a user moves one of the release levers to open the binder.

16. The ring metal of claim 15 further including a plurality of segments formed in each of said leaves with at least one segment formed intermediate the location where adjacent binder ring halves are attached to a leaf.

17. The ring metal of claim 16 further including an additional segment formed on each leaf between the location where an outer binder ring half attaches to said leaf and the end of said leaf.

18. The ring metal of claim 17 wherein said second angle is a shallower angle than said predetermined angle.

19. The ring metal of claim 18 wherein said predetermined angle is approximately 17° and said second angle is approximately 12°.

20. A method of preventing the inadvertent opening of a ring binder metal due to pressure exerted on a binder ring half comprising:

spacing a plurality of binder rings along the length of said ring binder metal, each binder ring being formed of a pair of ring halves;

separately attaching one end of each ring half to one leaf of a pair of leaves;

hingedly connecting said pair of leaves to each other for relative movement therebetween, movement of said leaves relative to each other in one direction moving the ring halves to open the ring binder metal and in the opposite direction to close the ring binder metal, said leaves, when said ring binder is closed, forming a predetermined angle with respect to a reference; and, forming on each of said leaves at least one segment by which a second angle is formed between the leaves with respect to said reference, said second angle being such that surfaces of said leaves where said second angle is formed contact each other to prevent binder ring opening movement which would otherwise occur due to movement of paper stored in the binder from one side of the binder to the other, but said leaves are otherwise readily movable to open said ring binder metal when a user so desires.

21. The method of claim 20 further including forming on each of said leaves a plurality of segments by which said second angle is formed, said segments being formed in each leaf between the location where adjacent binder ring halves attach to said leaf, and at each end of each leaf.

22. The method of claim 21 wherein said second angle is a shallower angle than said predetermined angle.

23. The method of claim 22 wherein said predetermined angle is approximately 17° and said second angle is approximately 12°.

24. The method of claim 23 further including positioning release levers at each end of said ring binder metal, said release levers being operable by a user of said ring binder metal to move said leaves to open and close the ring binder metal.

25. The method of claim 24 wherein further including fitting a cover over said leaves, said cover and having spaced openings formed therein along the opposites thereof for the respective binder ring halves to extend through said cover.

* * * * *